US006219999B1

(12) United States Patent
Ghini et al.

(10) Patent No.: US 6,219,999 B1
(45) Date of Patent: Apr. 24, 2001

(54) METHOD AND MACHINE FOR WRAPPING PRODUCTS

(75) Inventors: Marco Ghini, S. Lazzaro Di Savena; Mario Spatafora, Bologna, both of (IT)

(73) Assignee: G. D Societa Per Azioni, Bologna (IT)

( * ) Notice: Subject to any disclaimer, the term of this patent is extended or adjusted under 35 U.S.C. 154(b) by 0 days.

(21) Appl. No.: 09/345,126

(22) Filed: Jul. 6, 1999

(30) Foreign Application Priority Data

Jul. 8, 1998 (IT) ..... B98A00418

(51) Int. Cl.[7] ..... B65B 11/00; B65B 49/00; B65B 51/10

(52) U.S. Cl. ..... 53/466; 53/228; 53/234; 53/373.7; 53/375.9; 53/463; 53/477

(58) Field of Search ..... 53/461, 466, 586, 53/203, 228, 234, 373.7, 375.9, 477, 463

(56) References Cited

U.S. PATENT DOCUMENTS 2,720,738 10/1955 Brightwell .
4,718,216 * 1/1988 Focke et al. ..... 53/234
5,477,661 * 12/1995 Draghetti et al. ..... 53/466
5,794,413 * 8/1998 Draghetti ..... 53/466
5,839,253 * 11/1998 Draghetti ..... 53/234
6,023,909 * 2/2000 Boldrini ..... 53/234
6,062,000 * 5/2000 Focke et al. ..... 53/466

FOREIGN PATENT DOCUMENTS 1134500 11/1968 (GB) .
2206327 1/1989 (GB) .
2244970 12/1991 (GB) .

* cited by examiner

*Primary Examiner*—Peter Vo
*Assistant Examiner*—Louis Huynh
(74) *Attorney, Agent, or Firm*—Ladas & Parry

(57) ABSTRACT

A method and machine for wrapping products in respective sheets of heat-seal material, whereby the products are fed successively along a first wrapping path to form, about each product, a tubular wrapping having two opposite open ends, and are then fed successively along a second wrapping path to close and seal the respective open ends; the products being fed with a first spacing along the first wrapping path, and with a second spacing, smaller than the first spacing, along the second wrapping path.

16 Claims, 5 Drawing Sheets

METHOD AND MACHINE FOR WRAPPING PRODUCTS

The present invention relates to a method of wrapping products.

The present invention is particularly advantageous for use on machines for cellophaning packets of cigarettes, to which the following description refers purely by way of example.

BACKGROUND OF THE INVENTION

On known machines for cellophaning packets of cigarettes, the packets of cigarettes are fed by a first conveyor at a given speed along a first wrapping path to form respective tubular wrappings, each comprising two opposite open ends about the packet, and are fed by a second conveyor at the same speed along a second wrapping path to close the ends of each tubular wrapping.

As it normally takes longer to close the ends than to form the tubular wrapping, and as the packets are fed at the same given speed along both paths, the second path must necessarily be longer than the first, which normally means a considerable increase in the size and cost of the second conveyor, on account of numerous technical features normally preventing changes to other construction characteristics of the machine.

SUMMARY OF THE INVENTION

It is an object of the present invention to provide a method of wrapping products, designed to eliminate the aforementioned drawback, and which at the same time is cheap and easy to implement.

According to the present invention, there is provided a method of wrapping products in respective sheets of wrapping material, the method comprising the steps of feeding said products successively along a first wrapping path to form, about each product, a respective tubular wrapping having two opposite open ends; and feeding said products successively along a second wrapping path to close and stabilize the respective said open ends; the method being characterized in that said products are fed along said first wrapping path in spaced relation from one another at intervals forming a first spacing between sucessive products along said first wrapping path, and said products are fed along said second wrapping path in spaced relation from one another at intervals forming a second spacing, smaller than the first spacing.

The present invention also relates to a machine for wrapping products.

According to the present invention, there is provided a machine for wrapping products in respective sheets of wrapping material, the machine comprising a first conveyor for feeding said products successively along a first wrapping path; first wrapping means located along said first wrapping path to form, about each product, a respective tubular wrapping having two opposite open ends; a second conveyor for feeding said products successively along a second wrapping path; and second wrapping means located along said second wrapping path to close and stabilize the respective said open ends; the machine being characterized in that said first and said second conveyor provide for feeding said products with a first and a second spacing respectively, the second spacing being smaller than the first spacing.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
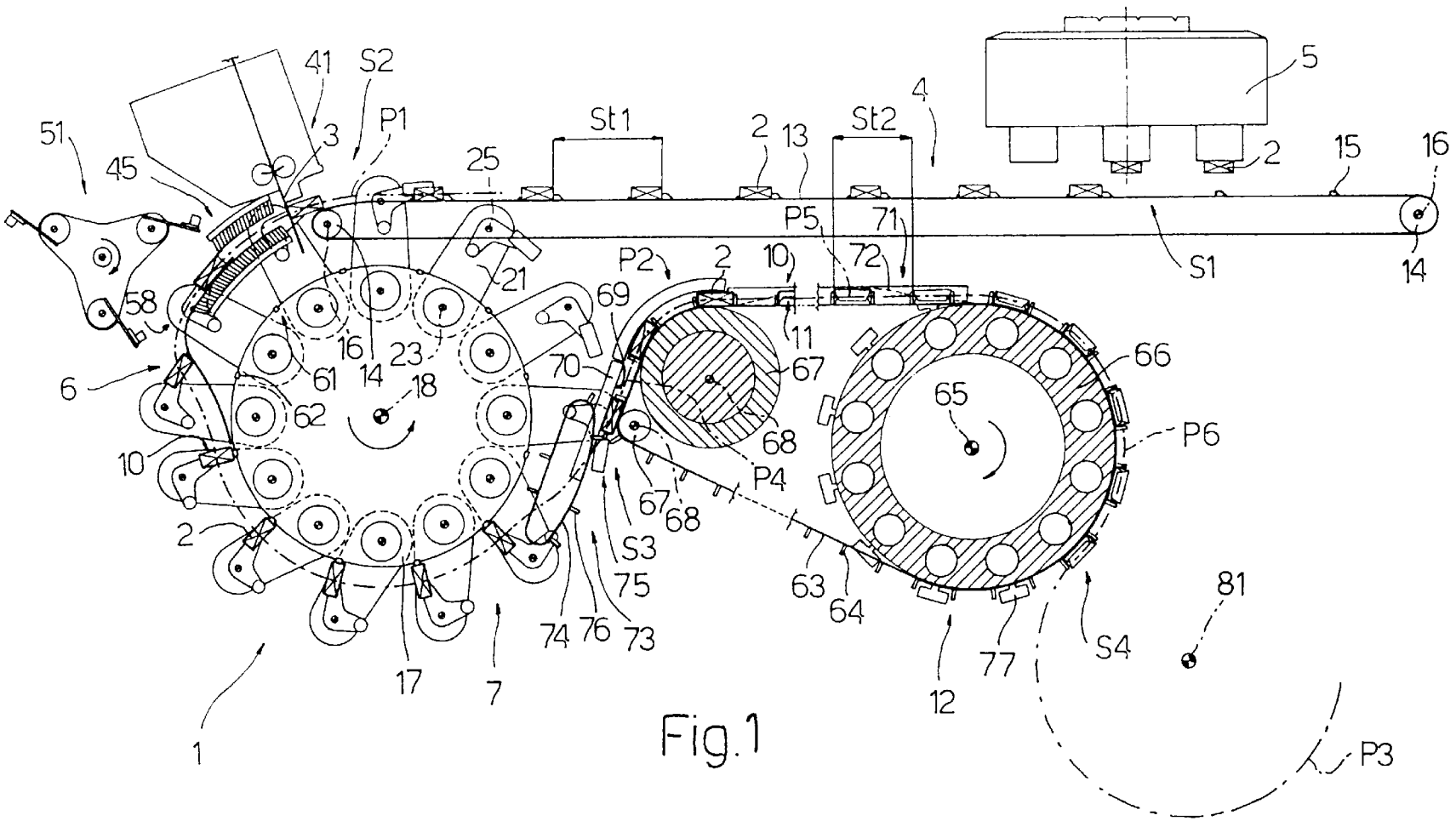
FIG. 1 shows a schematic, partially sectioned side view of a preferred embodiment of the machine according to the present invention.

Number 1 in FIG. 1 indicates as a whole a continuous cellophaning machine for overwrapping packets 2 of cigarettes in respective sheets 3 of heat-seal wrapping material.

Packets 2 are fed by a known supply device 5 to an input conveyor 4 of machine 1 at an input station S1.

Conveyor 4 feeds packets 2 from input station S1 to a transfer station S2 with a spacing St1 actually equal to approximately 180 mm; and, at station S2, each packet 2 is transferred to a respective conveyor head 6 fitted to a wrapping conveyor 7 to feed packets 2 successively along a wrapping path P1.

The spacing and the traveling speed of packets 2 along path P1 substantially equal St1 and V1 respectively. However, due to certain movements performed, in use, by head 6 with respect to conveyor 7 and described in detail later on, the spacing and traveling speed of packets 2 along path P1 vary temporarily about values St1 and V1 respectively.

Figure 4:
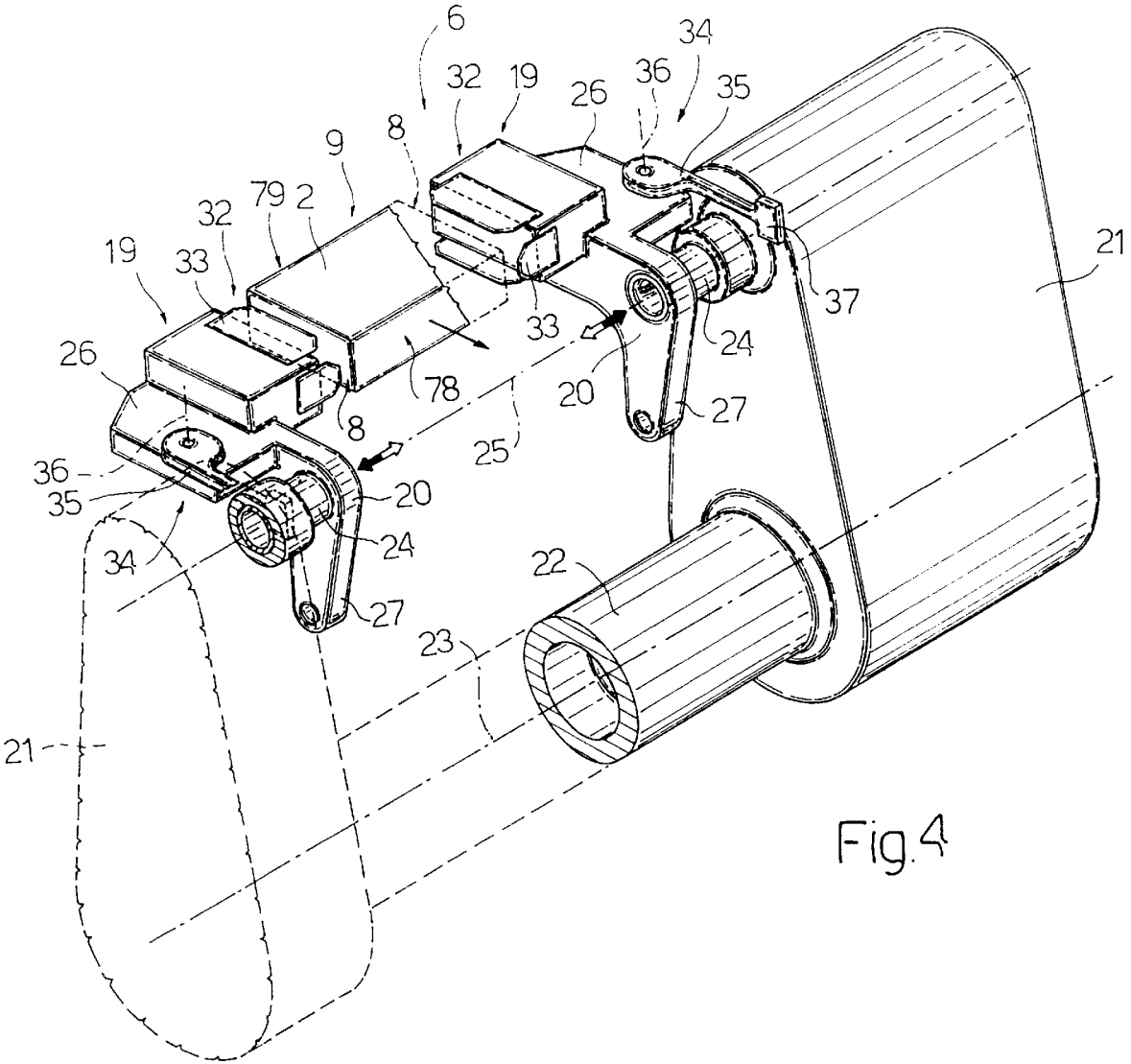
FIG. 4 shows a larger-scale view in perspective of a third detail in FIG. 1.

As shown more clearly in FIG. 4, each packet 2 is elongated and substantially parallelepiped, and comprises two opposite longitudinal end bases 8 and a lateral surface 9 perpendicular to bases 8; and each conveyor head 6 engages bases 8 of a respective packet 2.

Along path P1, each packet 2 is paired with a respective sheet 3 of wrapping material, which is subsequently folded to form about packet 2 a tubular wrapping 10, which has two opposite open ends 11, and at least partially encloses respective conveyor head 6.

Path P1 terminates at a transfer station S3 where each packet 2 is transferred to a wrapping conveyor 12 which feeds packets 2, enclosed in respective tubular wrappings 10, successively along a wrapping path P2 and with a spacing St2 smaller than spacing St1 and actually equal to 120 mm.

Along path P2, the open ends 11 of each tubular wrapping 10 are closed and stabilized by sealing to complete the overwrapping of packets 2 in respective sheets 3.

Path P2 terminates at a transfer station S4 where the overwrapped packets 2 are transferred to a known output section (not shown) which feeds packets 2 along a drying path P3 and then to a known output (not shown) of machine 1.

Packets 2 are therefore fed along conveyor 4 and, substantially, along path P1 with spacing St1, and are fed along path P2 with a spacing St2 smaller than St1. To maintain a constant flow of packets 2 (i.e. the number of packets 2 processed per unit time) along machine 1, the traveling speed V1 of packets 2 along conveyor 4 and path P1 must be greater than the traveling speed V2 of packets 2 along path P2. In particular, to maintain a constant flow, the ratio between spacings St1 and St2, which is actually 1.5, must equal the ratio between speeds V1 and V2.

Input conveyor 4 comprises a belt 13 looped about two end pulleys 14 and having projections 15 equally spaced with spacing St1 and for engaging respective packets 2. One of the two pulleys 14 is mounted idly to rotate about a fixed axis 16 perpendicular to the FIG. 1 plane, while the other pulley 14 is powered to rotate continuously about a further fixed axis 16 also perpendicular to the FIG. 1 plane.

Conveyor 7 comprises a powered wheel 17, which is mounted to rotate continuously about a fixed central axis 18 parallel to axes 16, and which supports a number of conveyor heads 6 equally spaced about axis 18.

As shown more clearly in FIG. 4, each conveyor head 6 comprises a pair of opposed gripping pads 19, each of which engages a respective base 8 of a packet 2 and is fitted to a respective rocker arm 20 connected to wheel 17 by a respective arm 21, which is fitted at one end—together with arm 21 of the opposite pad 19—to a shaft 22 connected in rotary manner to wheel 17 and oscillated, with respect to wheel 17 and about a respective axis 23 parallel to axis 18, by a known cam control device (not shown).

Each rocker arm 20 is hinged to respective arm 21, at the end opposite the end fitted to shaft 22, by means of a hollow shaft 24 fitted idly to arm 21 to rotate, with respect to arm 21, about a respective axis 25 parallel to axis 18, and to slide axially, with respect to arm 21, along axis 25.

Figure 2:
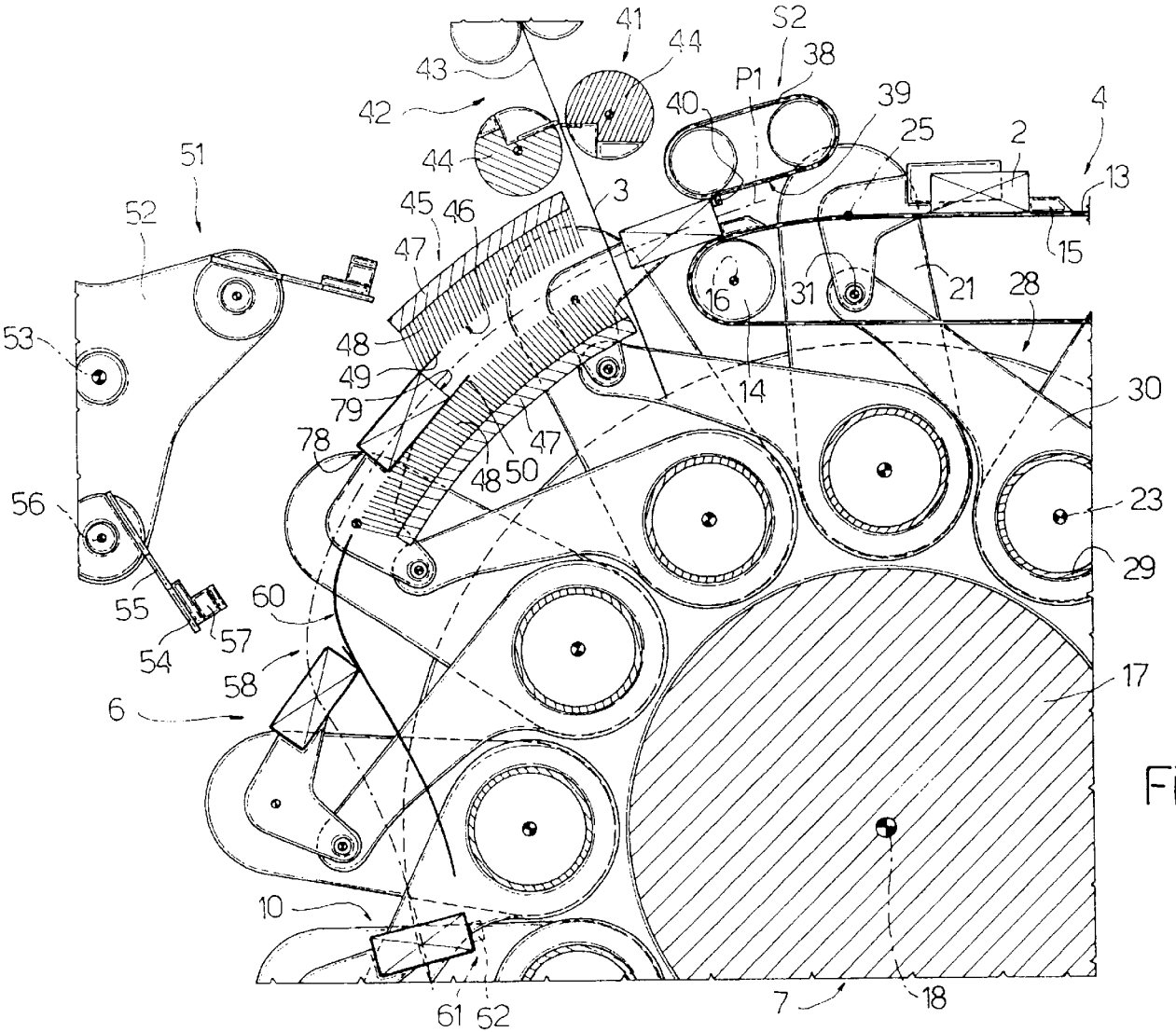
FIG. 2 shows a larger-scale view of a first detail in FIG. 1.

Each rocker arm 20 comprises an arm 26 fitted on the end with respective pad 19; and an arm 27, which, as shown in FIG. 2, is connected at the end to a control device 28 comprising a sleeve 29 fitted idly to shaft 22 of arm 21 of the head 6 immediately upstream in the rotation direction (anticlockwise in FIG. 1) of wheel 17. Sleeve 29 is also slid axially along said shaft 22 by a known cam control device (not shown). Device 28 also comprises a lever 30 integral with and extending radially from sleeve 29, and the free end of which is hinged at 31 to the free end of arm 27 of rocker arm 20.

Consequently, as each sleeve 29 slides axially along respective shaft 22, respective pad 19 is moved to and from a closed position (FIG. 5*a*) contacting respective base 8 of respective packet 2; and, as a shaft 22 and respective arm 21 oscillate about respective axis 23, respective rocker arm 20 oscillates about respective axis 25, given the constant distance between respective hinge 31 and axis 23 of the arm 21 immediately upstream in the rotation direction of wheel 17.

Each pad 19 comprises a cup-shaped body 32 projecting from pad 19 towards the opposite pad 19, and the bottom surface of which is defined by respective pad 19. Cup-shaped body 32 is axially and laterally open, and is defined by relatively thin metal plates 33 fitted to a lateral surface of respective pad 19 to contact, in use, lateral surface 9 of a respective packet 2.

Figure 5:
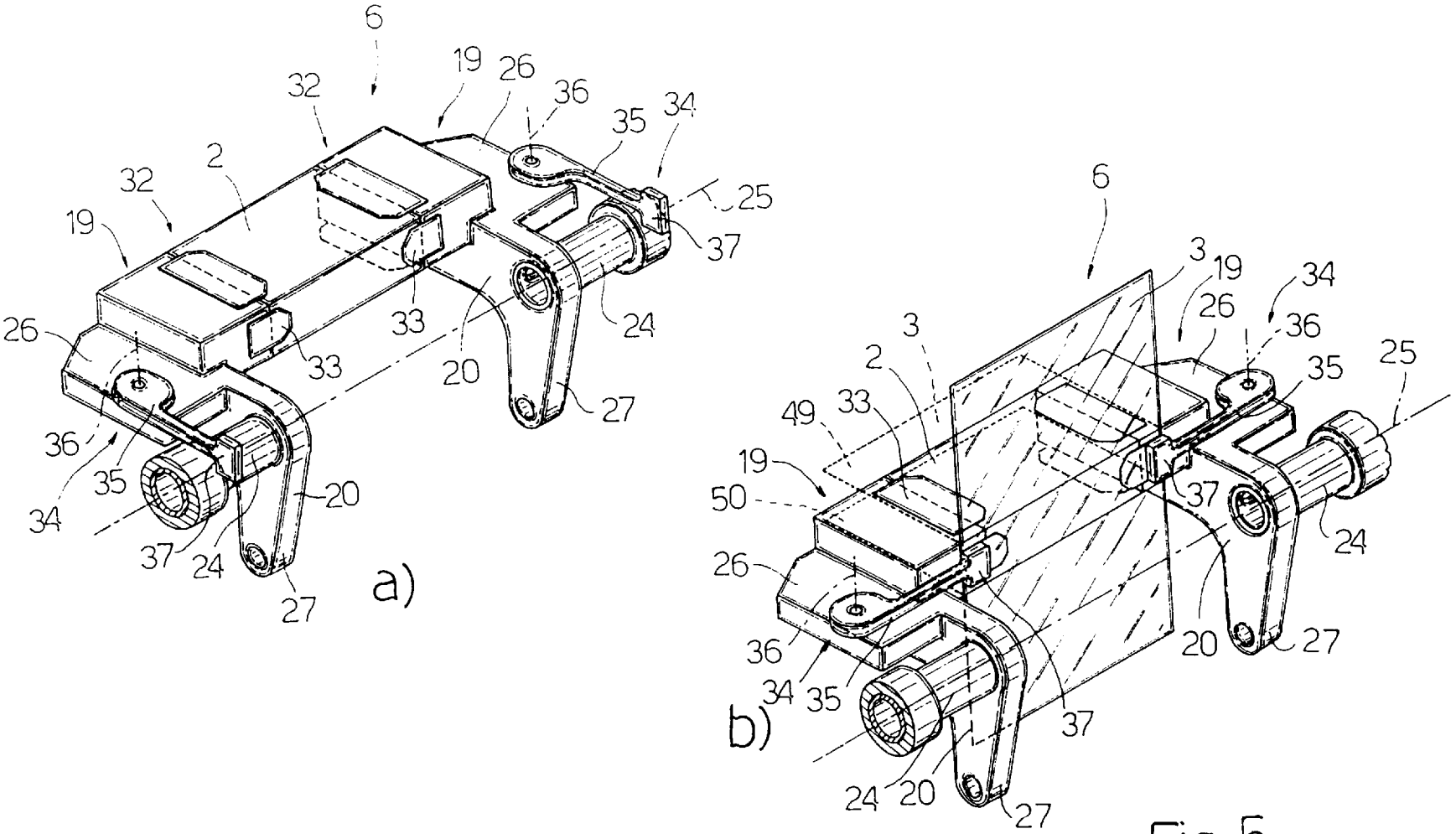
FIGS. 5(*a*) and (*b*) each shows a larger-scale view in perspective of a fourth detail in FIG. 1. in two different operating positions.

As shown more clearly in FIG. 5, each pad 19 comprises a respective retaining member 34 for retaining sheet 3 of wrapping material in a given fixed position with respect to pad 19. Retaining member 34 comprises a lever 35 hinged to respective rocker arm 20 and oscillated about an axis 36 crosswise to respective axis 25 by a known cam control device (not shown). Lever 35 carries an end pad 37, which is movable with lever 35 from a rest position (FIG. 5*a*) to a work position (FIG. 5*b*) in which end pad 37 laterally contacts respective gripping pad 19 to retain sheet 3 of wrapping material against gripping pad 19.

As shown more clearly in FIG. 2, machine 1 comprises a belt conveyor 38 located at transfer station S2, parallel to and facing conveyor 4, and defining, together with conveyor 4, a channel 39 for guiding packets 2 during transfer from conveyor 4 to respective conveyor heads 6 on conveyor 7. To better perform said guide function, conveyor 38 comprises a projection 40 for engaging a respective packet 2 together with respective projection 15 of conveyor 4.

Machine 1 comprises a supply station 41 for supplying sheets 3 of wrapping material, and which is located along an initial portion of path P1 and in turn comprises a known supply unit 42 for feeding a sheet 3 of wrapping material in a direction perpendicular to and through path P1. Supply unit 42 receives a continuous strip 43 of heat-seal wrapping material, which is unwound off a reel (not shown) and is cut by a pair of cutting rollers 44 into portions, each defining a sheet 3 of wrapping material.

Machine 1 comprises a passive wrapping fixture 45 (i.e. a fixture having no moving parts) located in a fixed position along path P1, immediately downstream from supply station 41, and which is defined by a folding channel 46 for folding a sheet 3 of wrapping material into a U about a respective packet 2 fed by a respective head 6 along path P1. Channel 46 is defined by a pair of facing walls 47 located on opposite sides of path P1 and having respective folding brushes 48.

Once folded into a U about respective packet 2, each sheet 3 of wrapping material has two wings 49 and 50 projecting transversely and rearwards from packet 2.

Machine 1 comprises an active wrapping fixture 51 (i.e. a fixture having at least one moving part) located along path P1, immediately downstream from folding channel 46, to fold wing 49 through 90° onto packet 2.

Active wrapping fixture 51 comprises a wheel 52 powered to rotate continuously about a fixed axis 53 parallel to axis 18; and a number of wrapping tools 54, each of which provides for folding wing 49 through 90° onto packet 2, and is connected to the free end of a respective arm 55. Each arm 55 is hinged to wheel 52 at the end opposite said free end, and is oscillated, with a given eccentricity and about an axis 56 parallel to axis 53, by a known cam control device (not shown).

Wrapping tool 54 comprises a generating device 57 for generating an electrostatic field, which acts on wing 49 to polarize and enable wing 49, once folded, to adhere at least temporarily to packet 2.

Machine 1 also comprises a passive wrapping fixture 58 located in a fixed position along path P1, downstream from folding channel 46, to fold wing 50 of sheet 3 of wrapping material through 90° onto respective packet 2 and partly onto the previously folded wing 49 to define respective tubular wrapping 10.

Wrapping fixture 58 comprises a body 59 having a surface 60, which defines a folding surface along which packet 2 is substantially rolled, by rotating respective head 6 about respective axis 25, to fold wing 50 through 90°.

The bottom wall 47 of folding channel 46 extends beyond the top wall 47 and up to the beginning of surface 60, with which it blends to keep the bottom portion of the U-folded sheet 3 in contact with respective packet 2.

Machine 1 comprises a number of passive wrapping fixtures 61, each of which is carried in a fixed position by wheel 17, is associated with a respective conveyor head 6, and is defined by a sealing device 62 for stabilizing a tubular wrapping 10 by on-edge sealing the superimposed portions of wings 49 and 50 folded onto respective packet 2.

As shown in FIG. 1, wrapping conveyor 12 comprises a conveyor belt 63 moving continuously along path P2 and having projections 64 spaced with spacing St2 to engage and feed forward packets 2. Path P2 comprises a straight initial portion P4; a downstream straight portion P5 connected to portion P4 by a curved portion; and a circular end portion P6 extending about a fixed axis 65 parallel to axis 18.

Along circular portion P6, belt 63 extends about a wheel 66 powered to rotate continuously about axis 65; and, at the opposite ends of portion P4, belt 63 extends about a pair of idle transmission rollers 67 rotating about respective axes 68 parallel to axis 65.

Conveyor 12 comprises a channel 69 extending along portion P4 and defined on one side by a fixed surface 70 and on the other side by conveyor belt 63.

Machine 1 comprises a folding device 71 located along straight portion P5 of path P2 to fold the open ends 11 of each tubular wrapping 10 onto respective packet 2 as packet 2 travels along portion P5 of path P2. Folding device 71 comprises a known first movable folding element (not shown) for making a first fold of open ends 11; and two known fixed helical folding elements 72 (only one shown in FIG. 1) located on either side of path P2 to engage respective open ends 11 of each tubular wrapping 10.

Machine 1 also comprises a transfer unit 73 located between conveyors 7 and 12 at transfer station S3, and which in turn comprises a belt 74 looped about a pair of end pulleys (not shown) to guide packets 2 to an input 75 of channel 69. Belt 74 comprises projections 76 spaced with spacing St1 to engage and feed forward packets 2 as packets 2 are transferred from conveyor 7 to conveyor 12.

Wheel 66 comprises a number of pairs of sealing heads 77 (only a first head in each pair shown in FIG. 1), which are equally spaced about axis 65 and provide for stabilizing, by sealing, ends 11 of each tubular wrapping 10 folded by folding device 71. The heads 77 in each pair are positioned facing each other to simultaneously engage respective opposite ends 11 of a respective tubular wrapping 10.

Operation of cellophaning machine 1 will now be described with reference to one packet 2, and as of the instant in which packet 2 is fed by supply device 5 onto conveyor 4 at station S1 and with spacing St1.

As shown in FIG. 1, conveyor 4 engages packet 2 by lateral surface 9, leaving bases 8 free, and feeds packet 2 continuously to station S2 where packet 2 is transferred to a respective head 6 which, rotating about axes 18, 23 and 25, feeds packet 2 along path P1.

As shown more clearly in FIG. 2, at station S2, respective control device 28 first positions pads 19 of head 6 facing and detached from bases 8 of packet 2 (FIG. 4), and then moves pads 19 into said closed position (FIG. 5*a*) in which respective cup-shaped body 32 of each pad 19 engages a respective longitudinal end of packet 2.

The above passage of pads 19 into the closed position is completed as packet 2 travels along guide channel 39, at the end of which, packet 2 leaves conveyor 4 and is conveyed solely by respective head 6 along path P1 and through supply station 41. At station 41, supply unit 42 has already positioned a respective sheet 3 of wrapping material, still attached to strip 43, perpendicular to path P1, so that, as packet 2 is fed along path P1, a portion 78—frontwards in the traveling direction—of lateral surface 9 of packet 2 engages a corresponding portion of sheet 3.

As packet 2 engages sheet 3, said known cam control device (not shown) moves levers 35 of respective head 6 into said work position (FIG. 5*b*) in which each respective end pad 37 laterally contacts respective gripping pad 19 to retain sheet 3 of wrapping material in a given fixed position against gripping pad 19. Sheet 3 is detached from strip 43 by cutting rollers 44 as soon as sheet 3 is clamped by pads 37.

At this point, as head 6 continues along path P1, packet 2 is fed into folding channel 46, which folds sheet 3 into a U about packet 2, about respective plates 33, and partly about respective pads 19. Folding sheet 3 into a U about plates 33 poses no problem on account of the relatively small thickness of plates 33 and the flexibility of packet 2 and sheet 3.

In an alternative embodiment not shown, folding channel 46 comprises a generating device for generating an electrostatic field, which acts on sheet 3 to polarize and enable sheet 3 to adhere at least temporarily to packet 2.

At the end of channel 46, sheet 3 is folded into a U about packet 2 with wings 49 and 50 projecting crosswise and rearwards from packet 2. As packet 2 continues along path P1, the top wing 49 is folded through 90° onto packet 2, and in particular onto a surface 79—rearwards in the traveling direction—of lateral surface 9 of packet 2, by a respective wrapping tool 54, which is caused to gradually engage wing 49 by the combination of wheel 52 rotating about axis 53, and respective arm 55 oscillating about axis 56.

In the course of the above folding operation, wing 49 is polarized by an electrostatic field, generated by generating device 57 fitted to tool 54, to adhere, once folded, at least temporarily to packet 2.

Figure 3:
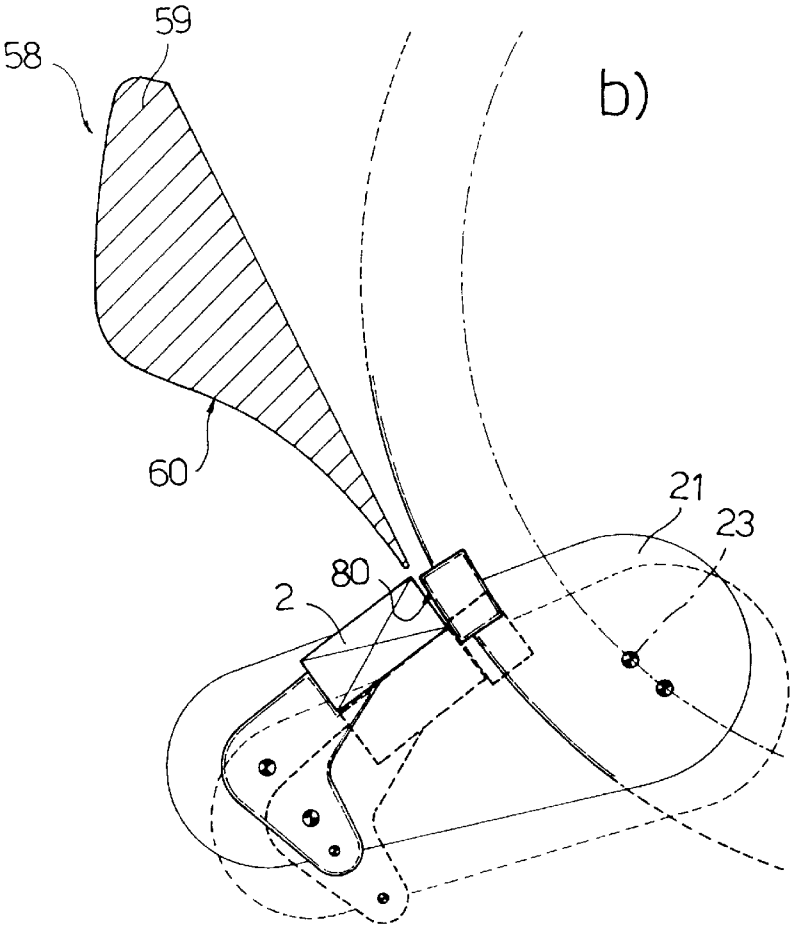
FIGS. 3(*a*) and (*b*) each shows a schematic, larger-scale view of a second detail in FIG. 1 in different operating positions.
Figure 3:
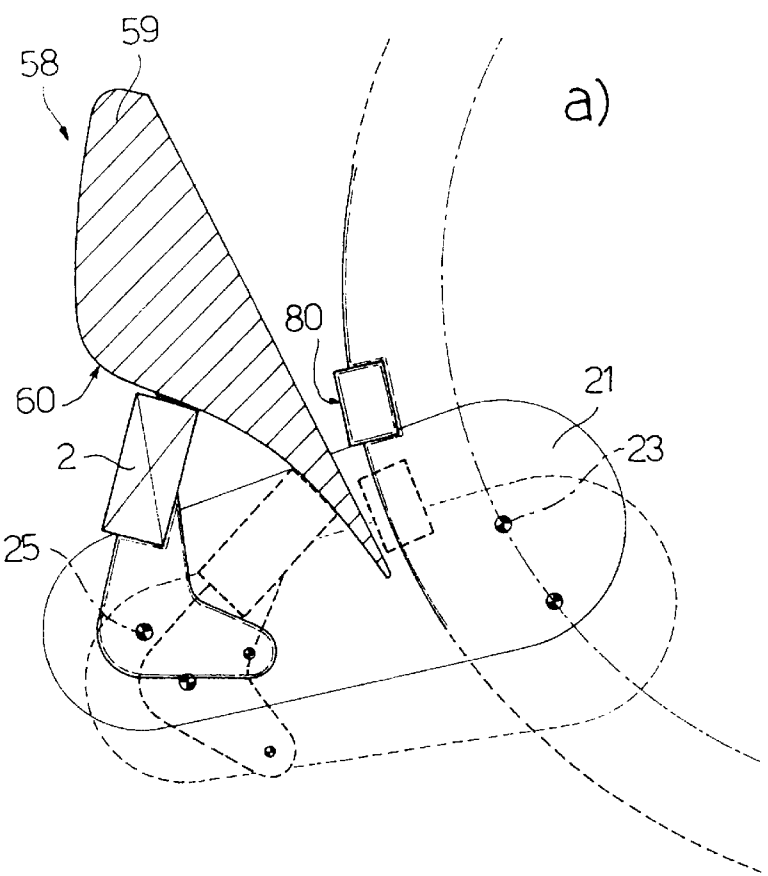

As shown in FIGS. 2 and 3, once wing 49 is folded, packet 2 is substantially rolled along folding surface 60 to fold the bottom wing 50 of sheet 3 of wrapping material through 90° onto surface 79 of packet 2 and partly onto the previously folded wing 49 to form tubular wrapping 10. Packet 2 is rolled along surface 60 by rotating respective head 6 about respective axis 25; which rotation is effected by said known cam control device (not shown) swinging respective arm 21 about respective axis 23, and provides for moving packet 2 from a substantially tangential to a substantially radial position with respect to axis 18.

As shown more clearly in FIG. 3, on leaving surface 60, surface 79, on which wings 49 and 50 have been overlapped, is engaged substantially seamlessly by a work surface 80 of a respective sealing device 62 carried on wheel 17 and associated with respective conveyor head 6. That is, on coming into contact with respective packet 2, surface 80 is so located as to form a substantially seamless extension of surface 60, thus preventing sheet 3, and in particular the newly folded wing 50, from springing back to its original configuration.

Surface 79 remains contacting sealing device 62 along a portion of path P1 extending more than 90° about axis 18, from the output end of folding surface 60 up to transfer station S3, and which is sufficient to seal the superimposed portions of wings 49 and 50 and so stabilize tubular wrapping 10.

Before reaching station S3, tubular wrapping 10 is released by retaining member 34, the pads 37 of which are restored to the rest position; and, at transfer station S3, packet 2 is restored to a substantially tangential position with respect to axis 18 by rotating respective head 6 about respective axis 25, which rotation is achieved by said known cam control device (not shown) swinging respective arm 21 about respective axis 23.

At station S3, packet 2 is engaged simultaneously by conveyor head 6 and by belt 74 of transfer unit 73, which assists in guiding packet 2 into channel 69 where packet 2 is engaged by belt 63 and respective projections 64.

On entering channel 69, packet 2 is engaged by belt 63, and in particular by projections 64 of belt 63, and is released by conveyor head 6, the two pads 19 of which are moved by control device 28 into an open position in which respective cup-shaped bodies 32 are separated by such a distance as not to interfere with packet 2 or respective tubular wrapping 10.

Since packets 2 are fed by conveyor 7 along path P1 at speed V1 and with spacing St1, and are fed by conveyor 12 along path P2 at speed V2 and with spacing St2, which are respectively slower and smaller than speed V1 and spacing St1, packets 2 undergo a change in speed at station S3, and in particular are slowed down during transfer from head 6 of conveyor 7 to conveyor 12. In one embodiment, the above change in speed is effected gradually by counter-rotating head 6 about respective axis 23 to temporarily reduce the speed of packet 2 with respect the speed V1 normally imposed by the rotation of wheel 17.

The continuous movement of belt 63 feeds packet 2 along path P2 and in particular through channel 69 to straight portion P5, along which the two opposite open ends 11 of tubular wrapping 10 are engaged by fixed helical folding elements 72 of folding device 71 and are folded onto bases 8 of packet 2.

At the end of straight portion P5, the two bases 8 of packet 2, onto which ends 11 of tubular wrapping 10 have been folded, are engaged simultaneously by respective sealing heads 77 in a respective pair of heads 77 on wheel 66 to stabilize, by sealing, ends 11.

Bases 8 remain in contact with respective sealing heads 77 along a portion of path P2 extending more than 90° about axis 65, from the output end of folding device 71 up to transfer station S4, and which is sufficient to seal ends 11 and so complete the overwrapping of packet 2 in sheet 3.

Path P2 terminates at transfer station S4 where the overwrapped packet 2 is transferred in known manner to said known output section (not shown), which feeds packet 2 along a circular drying path P3 extending about an axis 81 parallel to axis 65, and then to said known output (not shown) of machine 1.

In an alternative embodiment not shown, machine 1 comprises an application station located along conveyor 4 and having an application device for applying a label and/or coupon to each packet 2.

In a further embodiment not shown, folding surface 60 is provided with a respective generating device for generating an electrostatic field, which acts on wing 50 to polarize and enable wing 50, once folded, to adhere at least temporarily, to packet 2.

Machine 1 is therefore relatively straightforward and cheap to produce by comprising only three wrapping tools—two of which passive—which are shared by all of packets 2; and by wrapping wheel 17 comprising a small number of moving parts (conveyor heads 6) and only supporting passive wrapping fixtures (sealing devices 62).

Moreover, machine 1 comprises two main sections defined respectively by wrapping conveyors 7 and 12, and in each of which packets 2 are conveyed at a respective speed and with a respective spacing. More specifically, conveyor 7 feeds packets 2 along path P1 at speed V1 and with spacing St1, while conveyor 12 feeds packets 2 along path P2 at speed V2 and with spacing St2.

The above characteristic enables each section to operate with the spacing and/or at the speed best suited for the specific job performed by the section, and therefore provides for reducing cost and size for a given performance of machine 1. That is, along path P1, the wider spacing provides for better arranging heads 6 about axis 18, and the faster traveling speed of heads 6 for rapidly removing the U-folded sheet 3 from station 41 and so preventing wings 49 and 50 of sheet 3 from interfering with the next sheet 3. Along path P2, on the other hand, the narrower spacing and slower traveling speed enable the use of a relatively small-diameter wheel 66 to reduce the overall size of machine 1 within acceptable limits.

What is claimed is:

1. A method of wrapping products in respective sheets of wrapping material, the method comprising the steps of feeding said products successively along a first wrapping path to form, about each product, a respective tubular wrapping having two opposite open ends; and feeding said products successively along a second wrapping path to close and stabilize the respective said open ends; wherein said products are fed along said first wrapping path in spaced relation from one another at intervals forming a first spacing between successive products along said first wrapping path and said products are fed along said second wrapping path in spaced relation from one another at intervals forming a second spacing between successive products along said second wrapping path, said second spacing being smaller than said first spacing, each said product being an elongated, substantially parallelepiped product having two opposite longitudinal end bases at which said opposite open ends of the respective said tubular wrapping are formed; the formation of each said tubular wrapping comprising the steps of feeding a respective said product to a conveyor head, which engages the product by said bases; feeding said conveyor head continuously, by means of a conveyor, along said first wrapping path and through a supply station for supplying said sheet of wrapping material, to assign said conveyor head and said product to said sheet of wrapping material; and, along said first wrapping path, moving said conveyor head with respect to said conveyor so that said sheet of wrapping material cooperates with at least one passive wrapping fixture to form, about the product and with said sheet of wrapping material, said tubular wrapping at least partly enclosing said conveyor head.

2. A method as claimed in claim 1, wherein said sheets of wrapping material comprise heat-seal material; said open ends being stabilized by sealing.

3. A method as claimed in claim 1, characterized in that said first wrapping path comprises a first and a second portion in series in a traveling direction of said conveyor head; said sheet of wrapping material being folded into a U about the product and about at least part of said conveyor head along said first portion of the first wrapping path, and being further folded and then stabilized along said second portion of the first wrapping path to obtain said tubular wrapping; said passive wrapping fixture being located along said second portion of the first wrapping path.

4. A method of wrapping products in respective sheets of wrapping material, the method comprising the steps of feeding said products successively along a first wrapping path to form, about each product, a respective tubular wrapping having two opposite open ends; and feeding said products successively along a second wrapping path to close and stabilize the respective said open ends; wherein said products are fed along said first wrapping path in spaced relation from one another at intervals forming a first spacing between successive products along said first wrapping path and said products are fed along said second wrapping path in spaced relation from one another at intervals forming a second spacing between successive products along said second wrapping path, said second spacing being smaller than said first spacing, each said product being an elongated, substantially parallelepiped product having two opposite longitudinal end bases at which said opposite open ends of the respective said tubular wrapping are formed; said first and second spacings having a ratio of 1.5.

5. A machine for wrapping products in respective sheets of wrapping material, the machine comprising a first conveyor for feeding said products successively along a first wrapping path; first wrapping means located along said first wrapping path to form, about each product a respective tubular wrapping having two opposite open ends; a second conveyor for feeding said products for feeding said products successively along a second wrapping path; and second wrapping means located along said second wrapping path to close and stabilize the respective said open ends wherein said first conveyor feeds said products thereon in spaced relation at intervals therebetween forming a first spacing between successive products, said second conveyor feeds said products thereon in spaced relation at intervals therebetween forming a second spacing between successive products, said second spacing being smaller than said first spacing, said first conveyor comprising a powered first wheel rotatable about a fixed central first axis; and a number of conveyor heads, which are carried by said first wheel, are equally spaced about the first axis, and engage respective said products, said first conveyor comprises, for each said conveyor head, a respective arm interposed between said conveyor head and said first wheel, said conveyor head being hinged to a first end of the respective said arm to oscillate with respect to the arm about a second axis parallel to said first axis; and a second end of said arm being hinged to said first wheel to oscillate with respect to the first wheel about a third axis parallel to said first axis.

6. A machine as claimed in claim 5, wherein said sheets of wrapping material comprise heat-seal material; said second wrapping means comprising at least one sealing member for stabilizing said ends.

7. A machine as claimed in claim 5, wherein said second conveyor comprises a first conveyor belt traveling along said second wrapping path and having first projections spaced at said second spacing and for engaging and feeding forward said products.

8. A machine as claimed in claim 7, said second wrapping path comprises a straight first portion, a straight second portion, and a circular third portion extending about a fixed fourth axis parallel to said first axis; fixed closing means for closing said open ends being provided along said straight second portion.

9. A machine as claimed in claim 8, wherein said fixed closing means for closing said open ends comprise fixed helical folding elements.

10. A machine as claimed in claim 8, wherein said second conveyor comprises a second wheel rotatable about said fourth axis; said first conveyor belt extending about said second wheel.

11. A machine as claimed in claim 10, wherein said second wheel comprises a number of pairs of sealing heads; the sealing heads in each pair being positioned facing each other to engage respective said ends of the same tubular wrapping; and said pairs of sealing heads being equally spaced about said fourth axis.

12. A machine as claimed in claim 8, wherein said second conveyor comprises a channel extending along said first portion of said second wrapping path and defined, on one side, by a fixed surface, and, on an opposite side, by said first conveyor belt.

13. A machine as claimed in claim 12, wherein, along said first portion of said second wrapping path, said first conveyor belt extends about a pair of idle transmission rollers rotatable about axes parallel to said first axis.

14. A machine as claimed in claim 12, comprising a transfer unit located between said first and said second conveyors; said transfer unit comprising a second conveyor belt for guiding said products to an input of said channel; and said second conveyor belt having second projections spaced at said first spacing (St1) and for engaging and feeding forward said products.

15. A machine as claimed in claim 5, wherein each said product is an elongated, substantially parallelepiped product having two opposite longitudinal end bases at which said opposite open ends of a respective said tubular wrapping are formed; the machine further comprising a conveyor head fitted to said first conveyor and for engaging said bases of said product; a supply device for feeding said product to said conveyor head; a supply station for supplying said sheet of wrapping material and located along said first wrapping path to assign said conveyor head and said product to said sheet of wrapping material; at least one passive wrapping fixture for forming, about the product and with said sheet of wrapping material, said tubular wrapping at least partly enclosing said conveyor head; and first actuating means which provide, along said first wrapping path, for moving said conveyor head with respect to said first conveyor to cause said sheet of wrapping material to cooperate with said passive wrapping fixture.

16. A machine as claimed in claim 15, wherein said first wrapping path comprises a first and a second portion in series in a traveling direction of said conveyor head; said machine further comprising a first wrapping station located along said first portion to fold said sheet of wrapping material into a U about the product and about at least part of said conveyor head, and a second wrapping station located along said second portion to complete said tubular wrapping about said product.

* * * * *

UNITED STATES PATENT AND TRADEMARK OFFICE

CERTIFICATE OF CORRECTION

PATENT NO. : 6,219,999 B1
DATED : April 24, 2001
INVENTOR(S) : Marco Ghini, Mario Spatafora It is certified that error appears in the above-identified patent and that said Letters Patent is hereby corrected as shown below:

Title page,

Item [30], "B98A00418" should read -- BO98A 000418 --

Signed and Sealed this

Fourth Day of December, 2001

*Attest:*

Nicholas P. Godici

NICHOLAS P. GODICI

*Attesting Officer*

*Acting Director of the United States Patent and Trademark Office*